United States Patent [19]

Potin

[11] Patent Number: 4,660,680

[45] Date of Patent: Apr. 28, 1987

[54] MEANS AND METHODS FOR ERECTING A WORK PLATFORM UNDER THE DECK OF A STRUCTURE

[76] Inventor: Prosper L. Potin, 5801 Sylvia Dr., New Orleans, La. 70124

[21] Appl. No.: 693,965

[22] Filed: Jan. 23, 1985

[51] Int. Cl.[4] ..... E04G 3/14

[52] U.S. Cl. ..... 182/36; 182/150; 182/63

[58] Field of Search ..... 182/36, 150, 142, 145, 182/63, 37, 141; 14/22

[56] References Cited

U.S. PATENT DOCUMENTS

| | | | |
|---|---|---|---|
| 194,802 | 9/1877 | Caswell | 182/36 |
| 629,935 | 8/1899 | Sturgis | 14/22 |
| 1,929,325 | 10/1933 | Masterson | 182/36 |
| 3,454,133 | 7/1969 | Gregord | 182/36 |
| 3,550,723 | 12/1970 | Gentry | 182/63 |
| 3,735,951 | 5/1973 | Reed | 182/150 |
| 4,200,955 | 5/1980 | Kitchen | 182/36 |

*Primary Examiner*—Reinaldo P. Machado
*Assistant Examiner*—Alvin Chin-Shue
*Attorney, Agent, or Firm*—Robert C. Tucker; William David Kiesel

[57] ABSTRACT

Means and methods for erecting a work platform under a structure are provided whereby removable planks are supported by a plurality of cables strung between a plurality of platform travelers erected on either side of the structure. The planks are subsequently supported at various intervals by adjustable hanger mechanisms.

14 Claims, 7 Drawing Figures

MEANS AND METHODS FOR ERECTING A WORK PLATFORM UNDER THE DECK OF A STRUCTURE

BACKGROUND OF THE INVENTION

1. Field of the Invention

This invention relates generally to working platforms for performing work on structure, such as bridges. More particularly, this invention relates to such platforms which are erected below the decks of bridges.

2. Prior Art

There are many designs for working platforms which provide access to the underside of bridges or other structures. Examples of such designal may be found in the following U.S. patents:

| U.S. Pat. No. | Inventor | Title |
|---|---|---|
| 3,066,757 | Robinson | Traveling Scaffold |
| 3,076,552 | Goodell | Bridge Scaffold Apparatus |
| 3,524,520 | Tidwell | Traveling Scaffold |
| 3,550,723 | Gentry | Bridge Scaffold |
| 3,708,038 | Ewing, Jr. | Cantilever Support |
| 3,945,462 | Griswold | Hanger Brackets |
| 4,044,858 | Vikre | Maintenance Device For Use Underneath Deck Structures |
| 4,103,861 | Buchler | Arrangement for the Sectional Cantilever Projection of Multi-Panel Bridge Supporting Structures of Steel or Prestressed Concrete |
| 4,271,927 | Brown | Inspection or Maintenance Cradle |
| 4,276,959 | Barber | Quick Way Scaffold |

Heretofore, it has been believed that rigid trusswork or other such support was necessary to provide safe support. All of the above devices involve the use of relatively large structural members to support a platform under the deck of a structure. Erection and dismantling of such devices is expensive and time consuming. In many instances, special equipment, such as one or more cranes, is necessary for erection. Also, space restrictions will many times render some of these devices useless. Futhermore, many of the above devices are difficult to move from place to place on the structure and/or provide access to only a small area of the structure at a time. These devices also are not readily adaptable to various sizes of bridges or other structures.

BRIEF SUMMARY OF THE INVENTION

Considering the above, it is an object of this invention to provide means and methods for erecting a work platform under a structure wherein a work platform may be easily and swiftly erected or dismantled and whereby a minimum of space is consumed.

It is another object of this invention to provide such means and methods which require a minimum of equipment for erection or dismantling and are easily transported and stored.

It is still another object of this invention to provide such means and methods which maximize access to the structure.

It is a further object of this invention to provide such means and methods which are adaptable to various sized structures and which can be easily moved from place to place on the structure.

Still other objects and advantages of this invention will become apparent from the ensuing descriptions of the invention.

Accordingly, means and methods for erecting a work platform under a structure are provided whereby removable planks are supported by a plurality of cables strung between a plurality of platform travelers erected on either side of the structure. The interlocked planks are additionally supported at various intervals by adjustable hanger mechanisms. The means and methods are easily adaptable to various sized structures and may be erected and dismantled quickly using a minimum amount of equipment.

DETAILED DESCRIPTION OF PREFERRED EMBODIMENTS OF THE INVENTION

Figure 1:
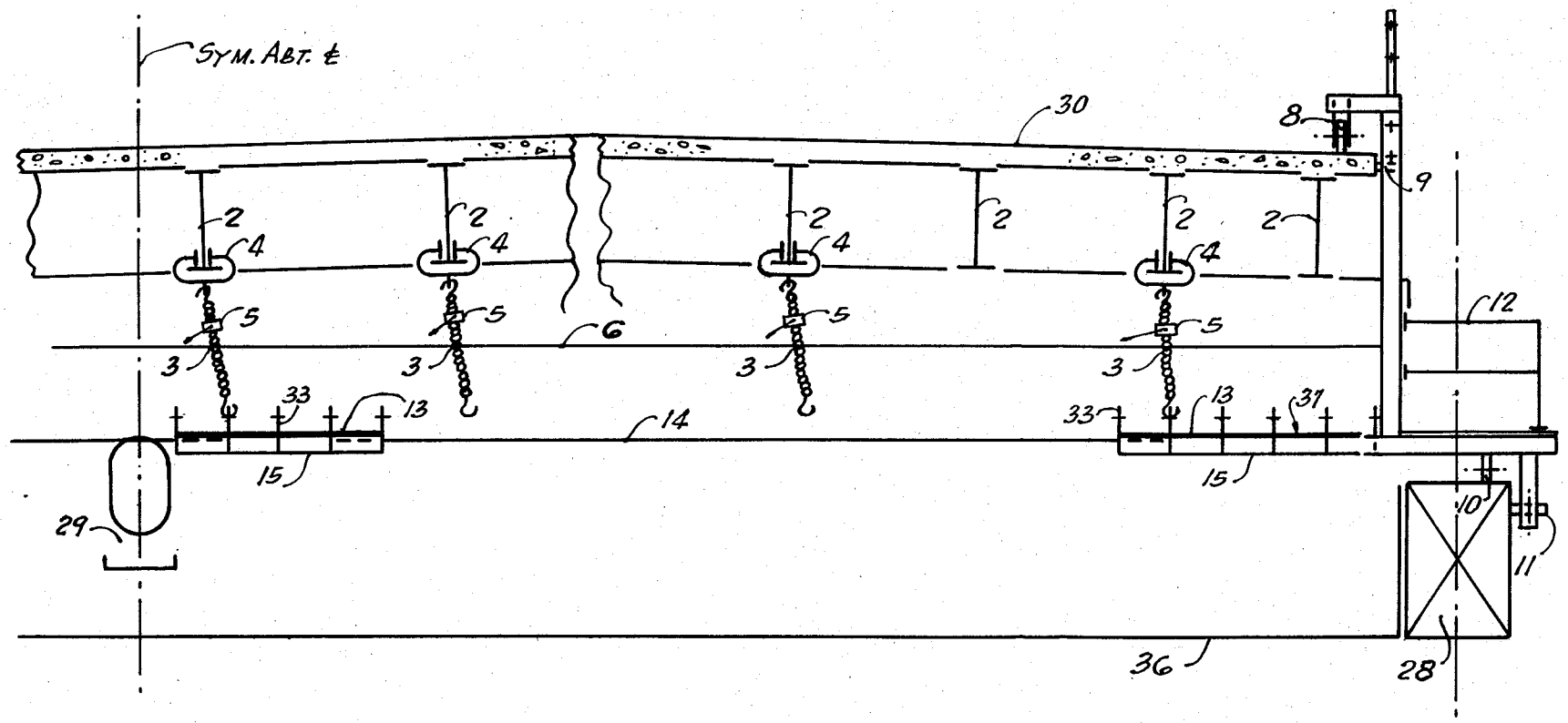
FIG. 1 is a side view of a preferred embodiment of the apparatus of this invention in place under a bridge.

As shown in the Figures, the apparatus of this invention forms a working platform on the underside of bridge 1. Although there are many configurations of bridges, a typical bridge 1 has a deck 30 which is supported by deck stringers 2. Additional support is provided by members such as truss bottom chord 28, and floor beam 36. The superstructure of a bridge often prevents use of many of the devices currently available. In larger bridges, an inspection walk 29 is often located beneath the deck 30. The apparatus of this invention generally comprises at least two working platform travelers 12 which are positioned on either side of the deck 30. It should be understood that FIG. 1 shows only one side of the structure, and that similar apparatus is positioned on the opposite side of deck 30. Between the travelers 12 are positioned a plurality of tensioned support cables 14, on which are laid deck planks 13. Additional support is provided at various intervals by hanger support means 3. It is preferred that the apparatus is adapted so as to be movable along bridge 1.

Figure 2:
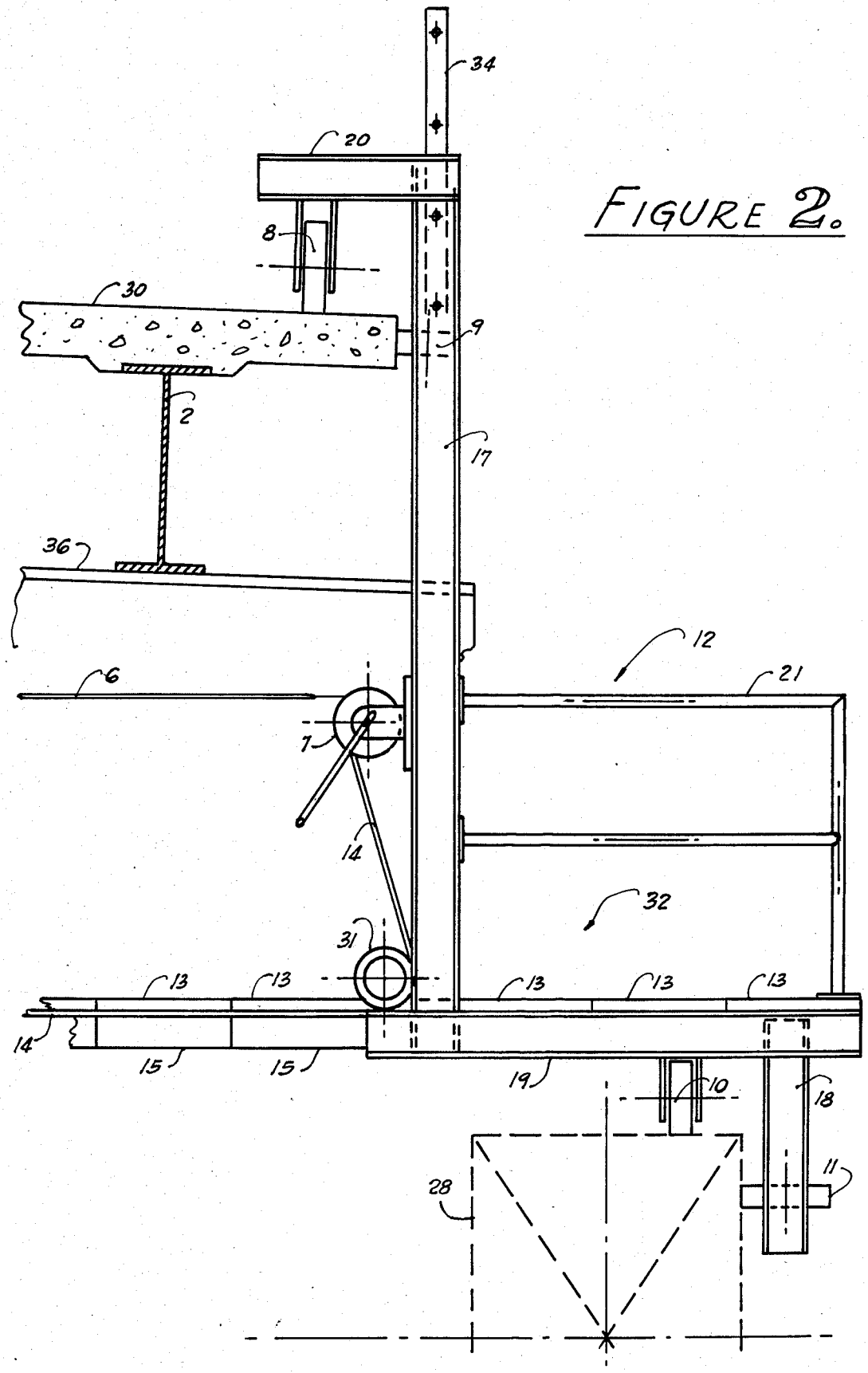
FIG. 2 is a more detailed side view of a preferred embodiment of the working platform traveler of this invention.
Figure 3:
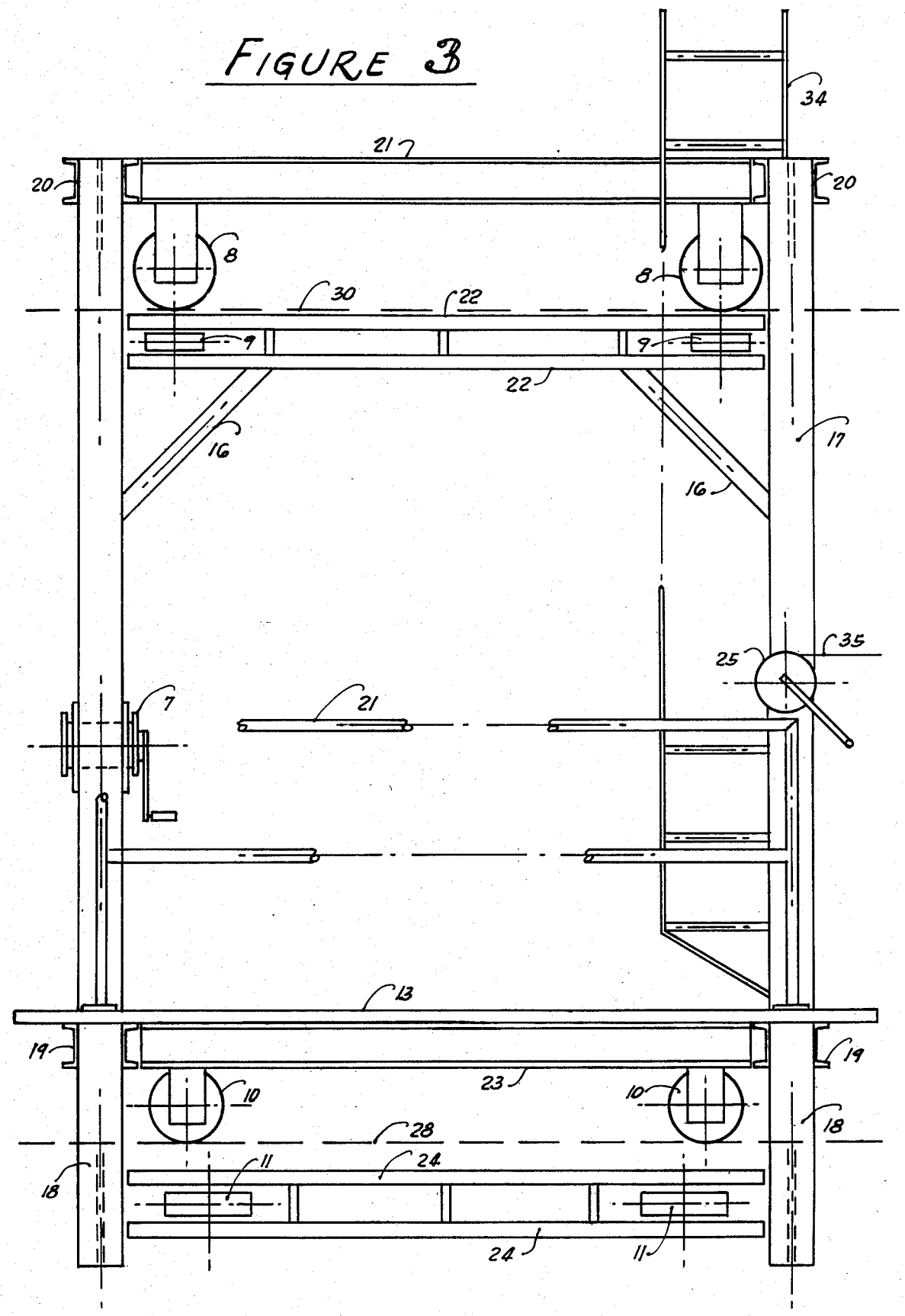
FIG. 3 is an end view of the working platform traveler taken along line 3—3 of FIG. 2.

The working platform traveler 12 is shown in more detail in FIG. 2. The traveler 12 may be adapted to fit most bridges. It is important, however, that the traveler 12 resist movement toward the underside of the deck 30. The embodiment shown in FIG. 2 accomplishes this task by bearing against bottom chord 28 with side chord wheel 11 and against the edge of deck 30 with side deck wheel 9. Ideally, the traveler 12 should bear against the top and side of deck 30 as well as the top and side of a superstructure member such as bottom chord 28. In the embodiment shown, top deck wheel 8, side deck wheel 9, top chord wheel 10 and side chord wheel 11 provide contact points between the traveler 12 and the bridge 1. The wheels 8, 9, 10 and 11 also allow the traveler 12 to move easily along the bridge 1 as work progresses.

Longitudinal movement winch 25 provides a means for urging the traveler 12 to so move.

Winch 7 and pulley 31 provide attachments for support cable 14. Preferably, pulley 31 should be located so as to place planks 13 at the same elevation as the platform area 32 on traveler 12. The platform area 32 may also be provided with planks 13 for flooring. Of course, the traveler 12 on the opposite side of deck 30 is also provided with a winch 7 and support cable 14 so as to provide a pair of tensioned support cables 14 on which planks 13 will rest.

Although many structural configurations for travelers 12 are possible, the embodiment shown comprises upper vertical beam 17, lower vertical beam 18, lower horizontal beam 19, and upper horizontal beam 20. Top cross member 22, middle cross member 23 and bottom cross member 24 provide additional support, as does bracing 16. All of these members are bolted together for ease of erection and dismantling. A ladder 34 may be provided for ease of access.

Figure 4:
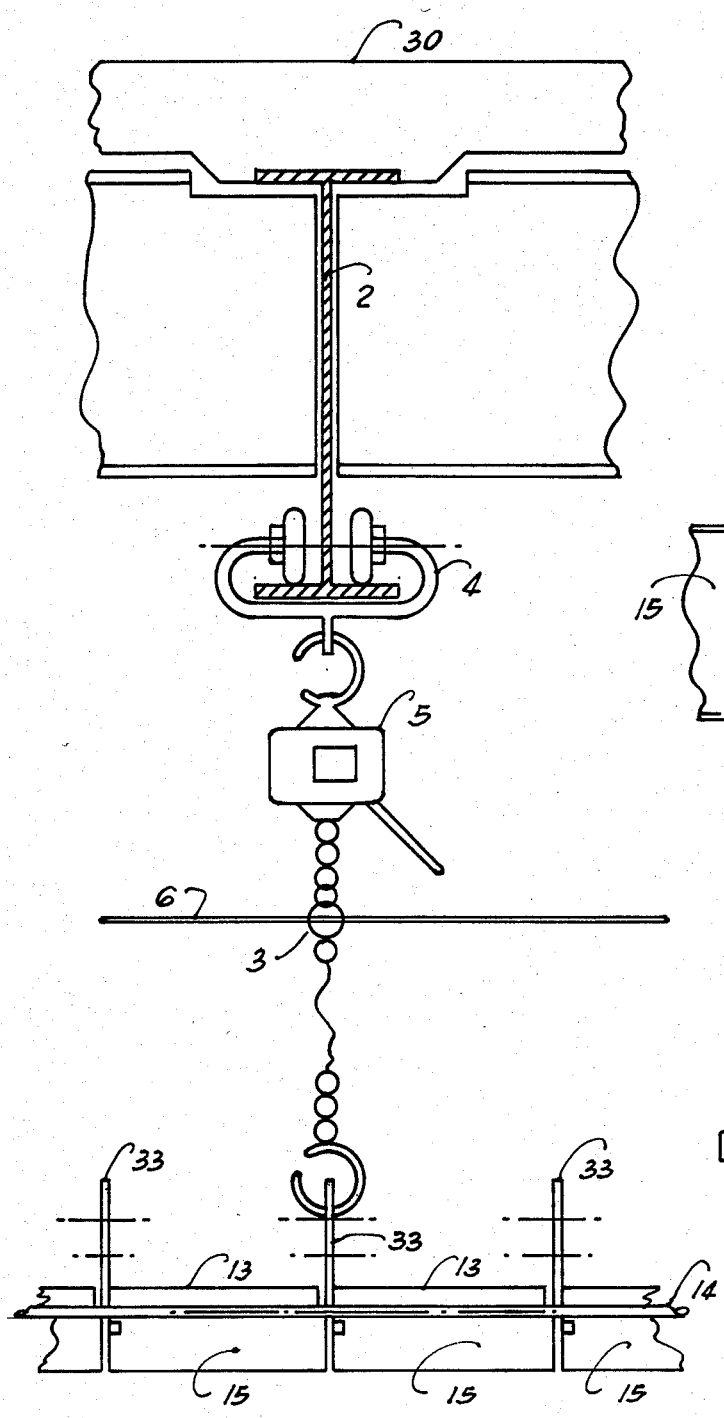
FIG. 4 is a more detailed view of a preferred embodiment of the hanger support means of this invention.
Figure 6:
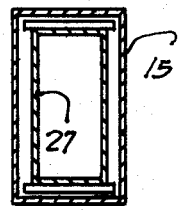
FIG. 6 is a sectional view taken along line 6—6 of FIG. 5.
Figure 5:
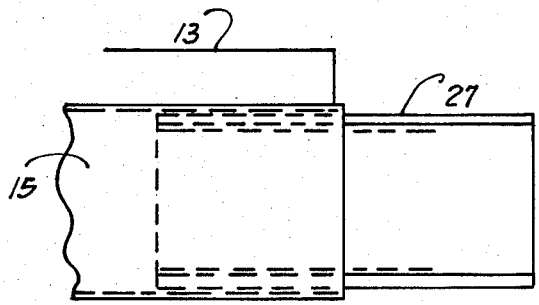
FIG. 5 is a more detailed view of the connection between the planks of this invention.
Figure 7:
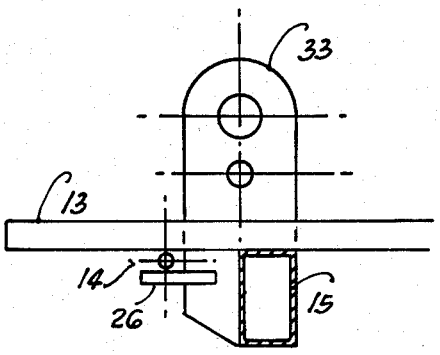
FIG. 7 is a partial sectional view taken along line 7—7 of FIG. 4.

Planks 13 are placed on support cables 14 to provide a working area under deck 30. Preferably, planks 13 should be made of a strong, but lightweight, material such as aluminum. Planks 13 should be long enough to safely span support cables 14. An overhang of one foot over each cable is preferable. Planks 13 are interconnected by longitudinal tubes 15 and 27, which are fixedly attached to the underside of planks 13. As shown in FIGS. 4–6, a small tube 15 protrudes from the side of one plank 13 and is matingly insertable into a large tube 27 in the next succeeding plank 13, allowing the planks 13 to interlock. Preferably, each plank should have a pair of tubes 27, 15 on one side and a pair of tubes 27, 15 of identical size on the other side, such that the planks 13 will be interchangeable and two interlocking connections can be made between planks 13. It is preferable that plank keepers 26 protrude from the underside of planks 13 to secure the planks 13 to support cables 14. There should be a keeper 26 on either end of each plank 13 to secure the plank 13 to both cables 14. The keepers 26 prevent uplift of one end of plank 13 when a workman steps beyond the opposite support cable 14 or when uplift wind forces may occur. Of course, other methods known in the art for interlocking planks 13 and securing planks 13 to cables 14 may be employed.

Additional support is provided by hanger support means 3. Each hanger support means 3 preferably comprises a trolley 4 and a hoist 5. The trolley 4 attaches to the flanges of a deck stringer 2, allowing for movement along the stringer 2. Hoist 5 runs from trolley 4 to the nearest available plank 13, where it is connectable to a support ear 33. Each plank 13 should be provided with a pair of support ears 33 so as to circumvent the necessity of aligning a specific plank 13 with a deck stringer 2. For stability and convenience, a support ear 33 should be located near either end of each plank 13 so that a pair of hanger support means 3 may be attached to each plank 13 as necessary. Additional safety is provided by two rows of aligned support ears 33 which provide a visual warning near the edge of the platform.

The apparatus of this invention is easily assembled and dismantled. For ease of installation, a rope should be placed transversely across the underside of each deck span during the initial bridge erection process. Once a deck 30 is constructed on the bridge 1, a working platform traveler 12 is placed on either side of the deck 30. The travelers 12 may be of different sizes and configurations in order to conform to the configuration of the bridge 1. Again, it is preferable that the travelers 12 comprise members which may be bolted together for ease of erection and dismantling. The support cable 14 from the winch 7 of one traveler 12 is attached to one end of the rope previously placed under the deck 30, and the cable 14 is pulled across the underside of deck 30 and attached to the traveler 12 on the opposite side of deck 30. This procedure is then repeated by pulling the cable 14 from the opposite traveler 12 back across the underside of deck 30 and attaching it in the same manner. The two cables 14 are thus suspended in catenaries under and across the bridge deck. Winches 7 are tightened to tension cables 14. If the deck span is large, temporary center support of cables 14 may be provided by attaching one or more beam trolleys 4 to stringers 2 near the center of the span, and supporting cables 14 with hoists 5 attached to trolleys 4. If the bridge 1 is provided with an inspection walk 29, this is an ideal place for such temporary support.

Starting from each traveler 12, planks 13 are placed across cables 14. The planks 13 should first be placed across cables 14 at an angle so as to engage plank keepers 26 under cables 14. Each successive plank 13 will interlock twice with the previous plank 13 by engagement of a large tube 27 and a corresponding small tube 15. It has been found that an ideal plank size is eighteen inches wide by twelve feet long, and an ideal spacing between cables 14 is ten feet, allowing a one foot overhang on each end of a plank 13.

When utilizing the above stated dimensions, no more than seven planks 13 should be placed on cables 14 until at least one hanger support means 3 is installed. This is accomplished by placing a pair of beam trolleys 4 over the flanges of a deck stringer 2 and attaching a pair of hoists 5 between the trolleys 4 and the nearest support ears 33 of the nearest installed plank 13. The hoists 5 may then be tightened to adjust the elevation of the platform. Before adjusting hoists 5, however, the next plank 13 should be positioned and interlocked to circumvent alignment problems.

The plank installation procedure described above is repeated until cables 14 are covered with planks 13 between the travelers 12. Cable railing 6 may then be installed between the travelers 12 and clamped to the hoists 5. This procedure forms a safe, rigid working platform which may be used for removing deck forms, painting, deck drainage work, etc. The platform is moved longitudinally by attaching cables 35 from longitudinal movement winches 25 to a position on an adjacent deck span and reeling the winches 25. The tension in the support cables 14 should be relaxed prior to movement.

The redundant support features of this invention add to its versatility. The planks 13 interlock to form a rigid surface 37 which is supported both by support cables 14 and hanger support means 3. Because of this redundancy and the large working area available, the need for safety nets is greatly reduced. Also, obstacles protruding from the underside of the bridge 1 may be avoided. When an obstacle is encountered, the support cable 14 nearest the obstacle may be removed along with the planks which interfere with the obstacle. The platform is then moved toward the obstacle to point where the removed cable 14 may be re-attached. The other support cable 14 is then removed, in order to completely pass the obstacle, and then is re-attached, along with the planks 13 which were previously removed. During this process, the hanger support means 3 and one support cable 14 are always safely supporting the platform.

When work is completed in the span, the planks 13, hanger support means 3 and travelers 12 are dismantled in the reverse order of erection, and moved to the next deck span. Upon completion of the project the major components, namely the trolleys 4, hoists 5, cables 14 and 6 and planks 13 are salvageable and ready for use on the next project. All that is needed is an adjustment of the configuration of platform travelers 12 to accommodate the new project.

As can be seen, means and methods for erecting a work platform under the deck of a structure are provided enabling a safe work platform having a large working area to be erected with a minimum of time, effort and equipment. Many other alternate embodiments will occur to those skilled in the art and are intended to be included within the scope of the following claims.

I claim:

1. A means for erecting a work platform beneath the deck of a structure, comprising:

a. a first working platform traveler, positionable against a structure deck and superstructure so as to resist tilting movement of said first traveler toward the underside of said deck;

b. A second working platform traveler, positionable against said structure deck and said superstructure so as to resist tilting movement of said second traveler toward the underside of said deck, said second traveler being positionable on the opposite side of said deck from said first traveler;

c. a working platform, capable of being readily dismantled, connected between said travelers comprising a plurality of support cables, attachable between said travelers beneath said deck structure, means on said travelers to tautly tension said cables between said travelers; and d. at least one plank, attachable to and supported said support cables.

2. A means for erecting a platform beneath the deck of a structure according to claim 1, wherein each said plank is provided with a plurality of plank keepers, which are positionable below each said support cable.

3. A means for erecting a platform beneath the deck of a structure according to claim 1, wherein each said plank is interlockingly connectable to adjacent planks so as to form a rigid surface.

4. A means for erecting a platform beneath the deck of a structure according to claim 1, wherein said travelers are provided with wheels at all points of contact with said structure, so as to permit longtiudinal movement along said structure.

5. A means for erecting a platform beneath the deck of a structure according to claim 4, wherein each said traveler is provided with a means for urging said traveler to move longitudinally along said structure.

6. A means for erecting a work platform beneath the deck of a structure according to claim 1, further comprising:

e. at least one hanger support means, for supporting said planks from the underside of said deck, said hanger support means being attachable between the underside of said deck and at least one of said planks.

7. A means for erecting a platform beneath the deck of a structure according to claim 6, wherein each said hanger support means further comprises a trolley, connectable to the underside of said structure and a hoist connectable between said trolley and at least one said plank.

8. A means for erecting a platform beneath the deck of a structure according to claim 6, wherein said travelers are provided with wheels at all points of contact with said structure, so as to permit longitudinal tilting along said structure.

9. A means for erecting a platform beneath the deck of a structure according to claim 8, wherein each said hanger support means further comprises a trolley, connectable to the underside of said structure and a hoist connectable between said trolley and at least one said plank.

10. A means for erecting a platform beneath the deck of a structure according to claim 9, wherein each said plank is interlockingly connectable to adjacent planks so as to form a rigid surface.

11. A means for erecting a platform beneath the deck of a structure according to claim 10, wherein each said plank is provided with a plurality of plank keepers, which are positionable below each said support cable.

12. A means for erecting a platform beneath the deck of a structure according to claim 11, wherein each said traveler is provided with a means for urging said traveler to move longitudinally along said structure.

13. A method for erecting a work platform beneath the deck of a structure, comprising the steps of:

a. positioning a first platform traveler against a structure deck and superstructure so as to resist tilting movement of said first traveler toward the underside of said deck;

b. positioning a second platform traveler against said deck and said superstructure so as to resist tilting movement of said second traveler toward the underside of said deck, said second traveler being positioned on the opposite side of said deck from said first traveler;

c. providing a working platform, capable of being readily dismantled, connected between said travelers, by tautly attaching a plurality of support cables between said first and second travelers; and d. attaching at least one plank to said support cables.

14. A method for erecting a work platform beneath the deck of a structure according to claim 13, comprising the additional steps of:

e. attaching at least one hanger support means, for supporting said planks from the underside of said deck, between the underside of said deck and at least one said plank.

* * * * *

UNITED STATES PATENT AND TRADEMARK OFFICE

CERTIFICATE OF CORRECTION

PATENT NO. : 4,660,680

DATED : April 28, 1987

INVENTOR(S) : Prosper L. Potin

It is certified that error appears in the above-identified patent and that said Letters Patent is hereby corrected as shown below:

In Column 6, Line 18, the word "tilting" should be deleted and the word --movement-- should be inserted in its place.

Figures 2, 4 and 5 should be deleted to be replaced with figures 2, 4 and 5 as shown on the attached sheets.

Signed and Sealed this

Third Day of July, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,660,680

DATED : April 28, 1987

INVENTOR(S) : Prosper L. Potin

It is certified that error appears in the above-identified patent and that said Letters Patent is hereby corrected as shown below:

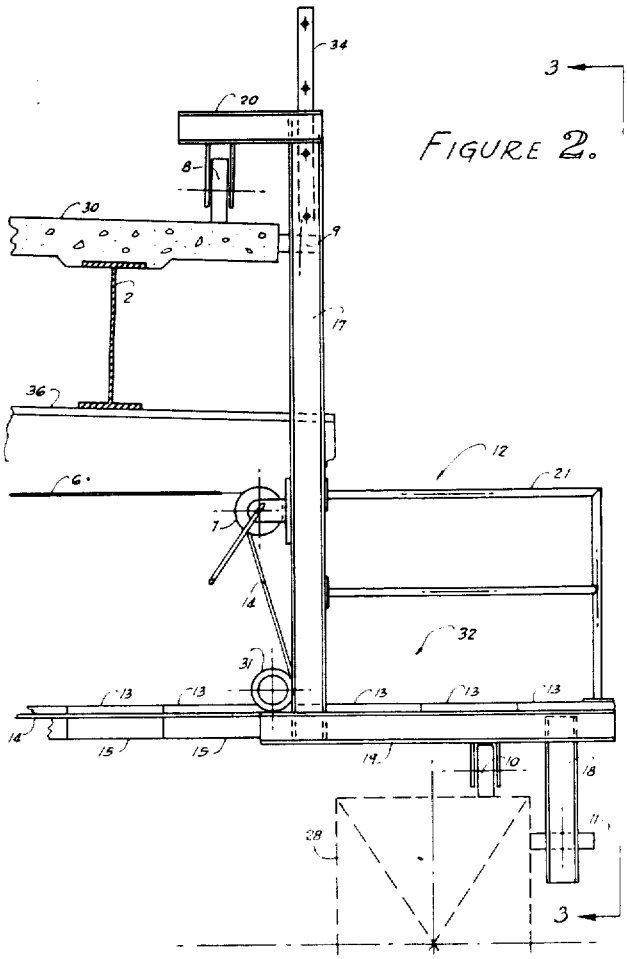

FIGURE 2.

UNITED STATES PATENT AND TRADEMARK OFFICE

CERTIFICATE OF CORRECTION

PATENT NO. : 4,660,680

DATED : April 28, 1987

INVENTOR(S) : Prosper L. Potin

It is certified that error appears in the above-identified patent and that said Letters Patent is hereby corrected as shown below:

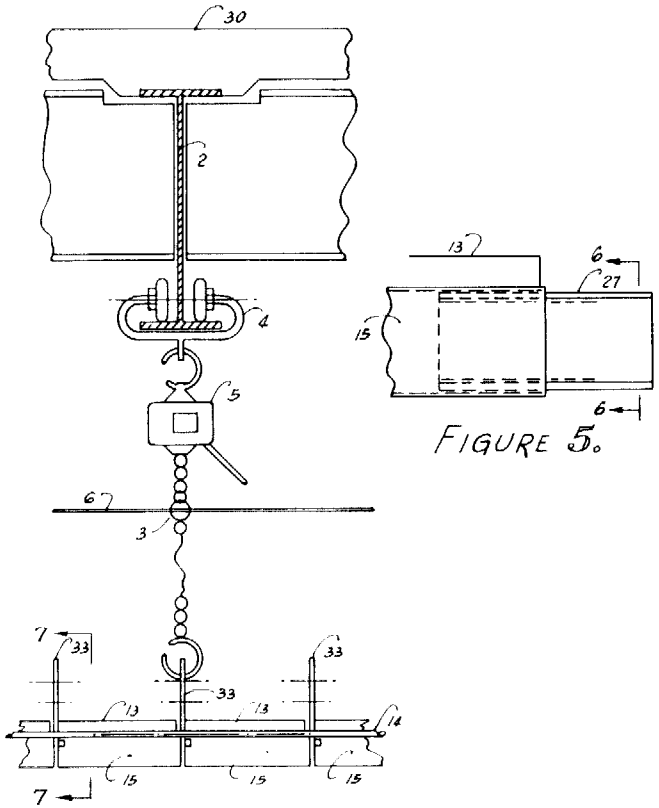

FIGURE 5.

FIGURE 4.